US005107741A

United States Patent [19]

Beals et al.

[11] Patent Number: 5,107,741

[45] Date of Patent: Apr. 28, 1992

[54] MUFFLER FOR BASS DRUMS

[75] Inventors: Robert C. Beals, Dodge City, Kans.; Robert A. Gatzen, Newington, Conn.

[73] Assignee: Evans Products, Inc., Dodge City, Kans.

[21] Appl. No.: 640,273

[22] Filed: Jan. 11, 1991

[51] Int. Cl.[5] ..... G10D 13/02

[52] U.S. Cl. ..... 84/411 M

[58] Field of Search ..... 84/411 R, 411 M

[56] References Cited

U.S. PATENT DOCUMENTS

| | | | |
|---|---|---|---|
| 4,242,937 | 1/1981 | Pozar | 84/411 R |
| 4,519,288 | 5/1985 | Aluisi | 84/411 M |
| 4,577,541 | 3/1986 | Edge | 84/411 R |
| 4,745,839 | 5/1988 | Peraino | 84/411 M |

*Primary Examiner*—Brian W. Brown

*Attorney, Agent, or Firm*—Kokjer, Kircher, Bowman & Johnson

[57] ABSTRACT

A muffling device for enhancing the sound and feel of a bass drum. The muffling device includes a flat pad and a pillow which is hinged to the pad and which exerts spring resistance to flexure about the hinge. The underside of the pad has a pair of fastening strips for application to mating fastening strips on the drum body to secure the pad in the drum body with the pillow flexed about its hinge and resting against the batter head of the drum to apply a tension force to it. The pad and pillow have sound absorbing cores continued within netting having mesh openings through which the cores are exposed.

20 Claims, 3 Drawing Sheets

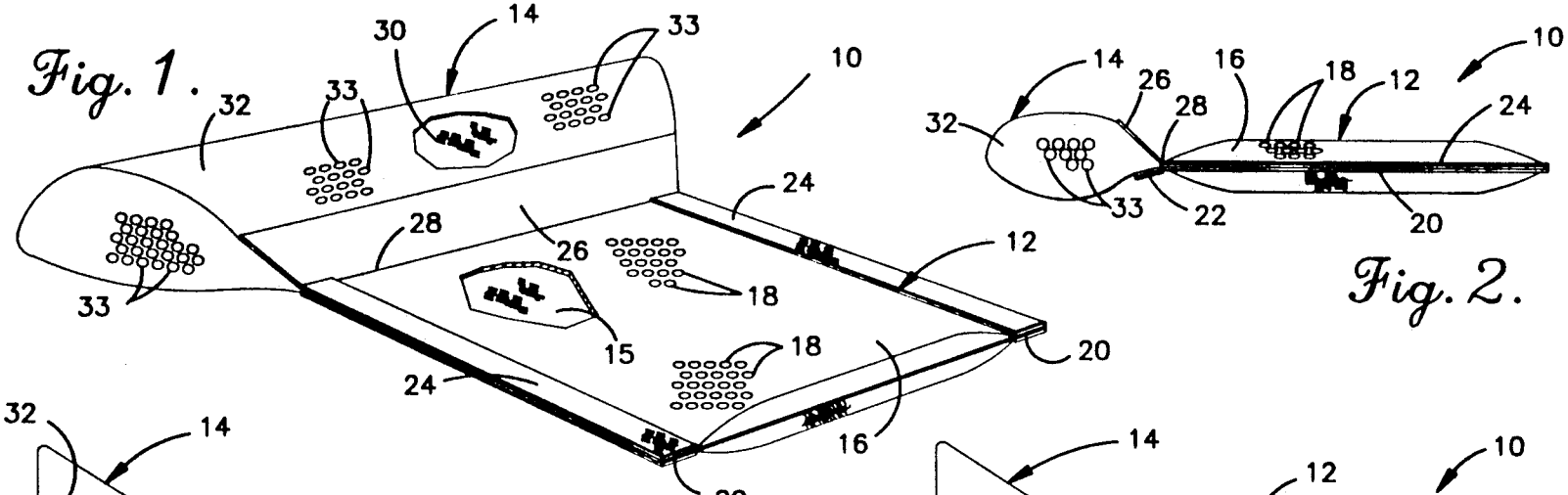
Fig. 1.
Fig. 2.
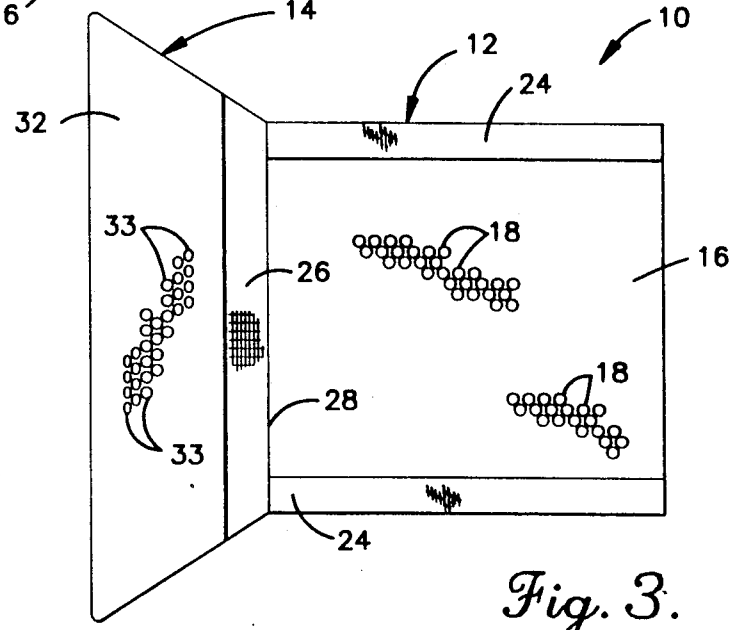
Fig. 3.
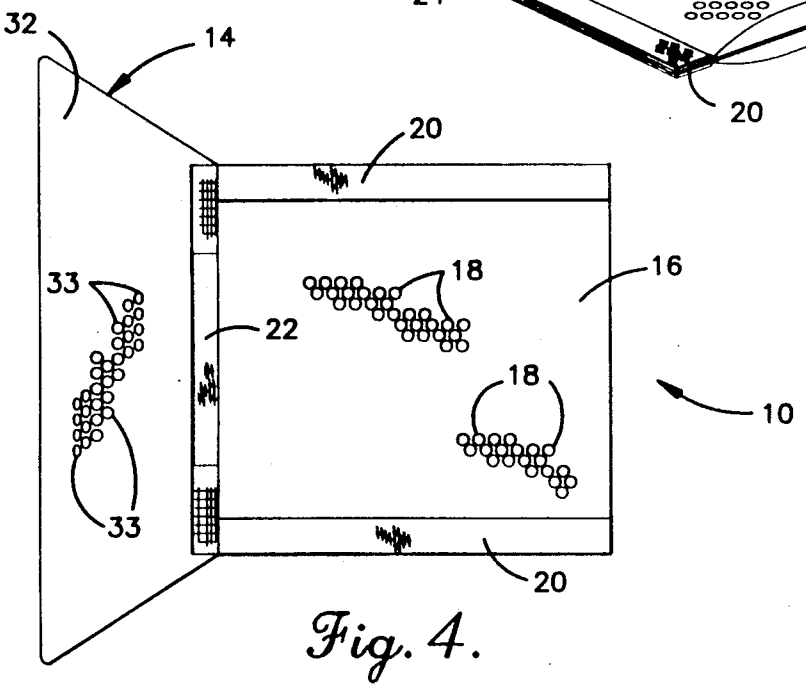
Fig. 4.

MUFFLER FOR BASS DRUMS

BACKGROUND OF THE INVENTION

This invention relates generally to drums and more particularly to a muffling device for enhancing the sound of bass drums.

Drummers, sound engineers and others knowledgeable in the music field and particularly in the acoustical properties of drums have recognized the desirability of muffling bass drums in order to suppress unwanted tones and enhance the sound of the drum. In the past, articles such as ordinary blankets, pillows and other available objects having the ability to absorb sound have been inserted into the shell of the drum in order to provide a muffling effect. These materials are normally stuffed into the drums such that they apply constant pressure against its batter head and also against its front head. As a result of the constant pressure desirable sounds are muffled along with some of the undesirable tones. The use of pillows and blankets also adversely affects the "feel" of the drum and thus detracts from the performance of the drummer.

This makeshift approach to muffling bass drums has become less and less desirable in recent years because of the increasingly higher demands for good sound quality that have accompanied digital recording techniques and other modern technical advances Consequently, it has become increasingly clear that there is a need for more effective muffling of bass drums. The present invention is directed principally at providing a more effective muffling device than has been available in the past.

SUMMARY OF THE INVENTION

In accordance with the invention, a sound absorbing pillow has a resilient hinge connection to a flat pad which is also constructed of sound absorbing material Preferably, both the pillow and pad have a sound attenuating core contained within netting which presents mesh openings that allow the sound waves to reach the sound absorbing core. The inside of the bass drum body is provided with a pair of parallel fastening strips that mate with fastening strips on the underside of the pad. The fastening strips may take the form of mating hook and loop fasteners of the type commercially available under the trademark VELCRO.

The pad is applied in the drum body at a location to maintain the pillow against the inside surface of the batter head with the pillow flexed about its hinge axis. The pillow resists flexure about the hinge axis by spring action, and this maintains the pillow against the batter head under tension. As a consequence, the pillow is able to effectively muffle the batter head when it is struck initially. However, the force applied to the batter head displaces the pillow away from it so that vibrations of the head subsequent to the initial impact are not muffled. The resiliency of the hinge connection quickly returns the pillow to its position against the batter head to muffle the decaying vibrations that are not acoustically desirable.

It is a particular feature of the invention that the tension exerted on the batter head by the pillow can be easily adjusted simply by moving the pad toward or away from the head as permitted by the fastening strips Increased tension of the pillow provides increased muffling and decreases the time that the pillow remains displaced from the batter head. Also, the harder the drumhead is hit, the longer the pillow stays away from it, and hitting the drumhead harder or softer thus changes its sound.

The muffling device of the present invention is well suited for internal microphone applications because the pad has a fastening patch or other means for allowing a microphone to be secured to it internally of the drum. Two or more of the devices can also be stacked one on top of another such that the tension forces exerted by the pillows are additive, thus increasing the overall tension on the drumhead. The top of each pad has fastening strips for firmly securing the overlying pad in place. The muffling devices can also be applied in pairs with one pillow against the batter head and the other pillow against the front head in situations where muffling of the front head is desired. Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:

FIG. 1 is a perspective view of a muffling device constructed according to a preferred embodiment of the present invention, with portions broken away for purposes of illustration;

FIG. 2 is a side elevational view of the muffling device shown in FIG. 1;

FIG. 3 is a top plan view of the muffling device;

FIG. 4 is a bottom elevational view of the muffling device;

DETAILED DESCRIPTION OF THE INVENTION

Figure 5:
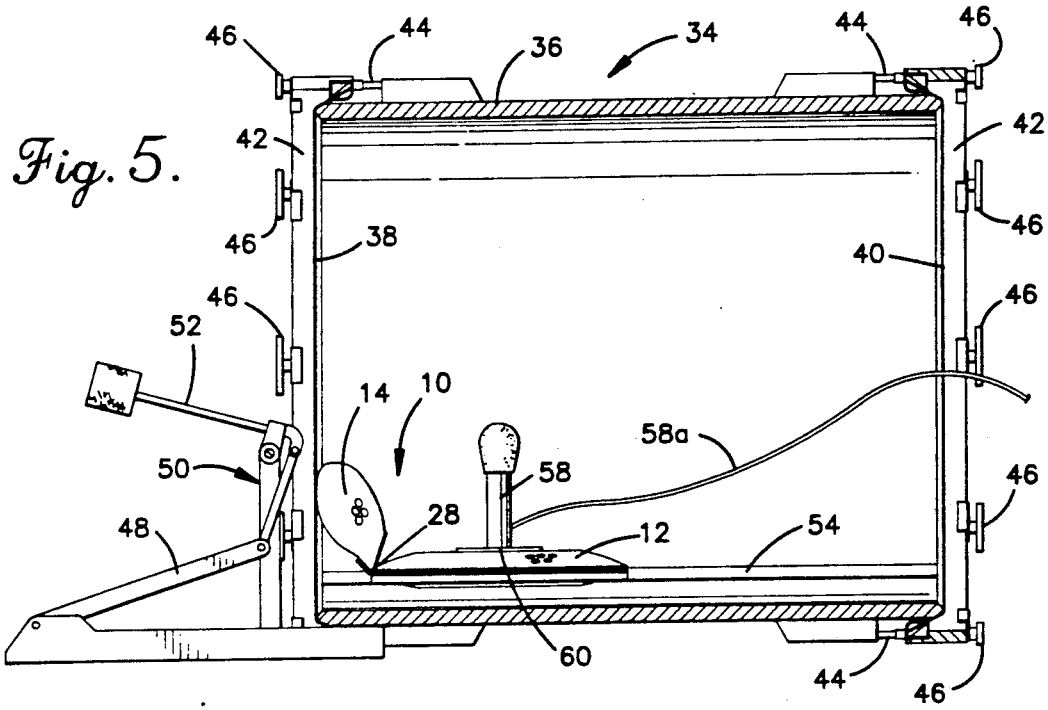
FIG. 5 is a sectional view on a vertical plane showing the muffling device of the present invention in place within a bass drum in order to muffle the batter head of the drum, with an internal microphone applied to the device.

Referring now to the drawings in more detail and initially to FIGS. 1–4, numeral 10 generally designates a muffling device which is used for the muffling of a bass drum. The muffling device 10 includes as its principal components a pad 12 and a pillow 14 which has a hinged connection with the pad 12.

The pad 12 is a generally flat, rectangular structure which includes a sound absorbing core 15 contained within a netting 16 which may be sewn or otherwise secured around the core 15. The core 15 may be constructed of a suitable sound absorbing material such as a sound absorbing fabric or foam. The netting 16 presents mesh openings 18 through which the core 15 is exposed in order to permit sound waves to reach and be absorbed by the core. The netting may be constructed of nylon or any other suitable material, and the bottom portion may be solid nylon or some other material rather than netting The bottom surface of the pad 12 is provided along its opposite side edges with a pair of parallel fastening strips 20 (see FIG. 4). The fastening strips 20 may be sewn or otherwise secured to the pad 12. A transverse fastening strip 22 is secured to the underside of pad 12 at its forward end.

The top surface of the pad 12 is provided on its side edges with a pair of fastening strips 24 which are constructed to releasably mate with the strips 20. Preferably, the strips 20 and 24 are constructed of mating hook and loop fasteners of the type commercially available under the trademark VELCRO. A transverse strip 26 on the top surface of pad 12 may be provided with fasteners constructed to mate with the fasteners on the transverse bottom strip 22.

The pillow 14 is connected with the forward edge of the pad 12 for flexure about a transverse hinge axis 28. When the pillow 14 is flexed about the hinge axis 28 from the position shown in FIG. 1, it resists the flexure by resilient spring action which continuously urges the pillow to return to the unflexed position shown in FIGS. 1 and 2.

The pillow 14 has a tapered configuration and tapers along both sides from its forward end to its connection with the pad 12 at the hinge axis 28. The pillow 14 is somewhat thicker than the pad 12 and has a sound absorbing core 30 contained within a netting 32 having mesh openings 33 through which the core is exposed. The netting may be sewn or otherwise secured around the sound absorbing core 30. The core may be constructed of a sound absorbing fabric, foam or other suitable material.

Figure 6:
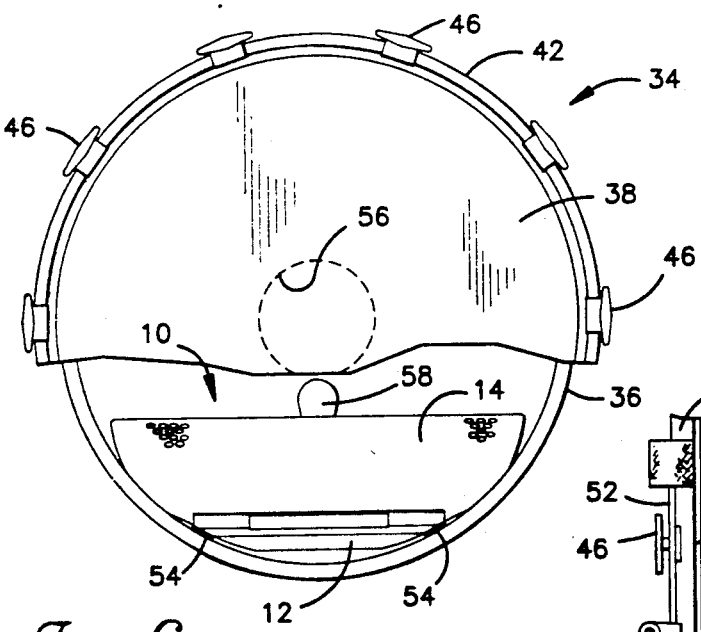
FIG. 6 is a front elevational view of the bass drum shown in FIG. 5, with a portion of the batter head broken away for purposes of illustration.
Figure 7:
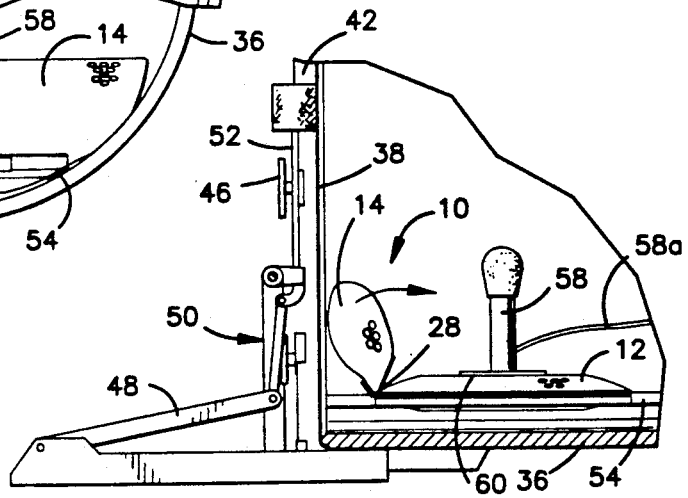
FIG. 7 is a fragmentary sectional view similar to FIG. 5, but showing the pillow of the muffling device displaced from the batter head of the drum upon initial striking of the drumhead with a drumstick.

Referring now to FIGS. 5–7, the muffling device 10 may be used to muffle the sound of a bass drum such as the drum generally identified by numeral 34. The drum 34 has a cylindrical body or shell 36 equipped on one end with a batter head 38 and on the other end with a front head 40. The drumheads are held on the shell by counterhoops 42 which are tightened by tension rods 44 equipped with tee handles 46. The tension rods permit the drumhead tension to be adjusted A pedal 48 located near the batter head 38 operates through a linkage 50 to drive the head of a drumstick 52 against the center of the batter head 38 when the pedal is depressed. The shell 36 is provided on its inside surface with a pair of parallel fastening strips 54 located near the bottom of the shell. The strips 54 are constructed to mate with the bottom fastening strips 20 on the pad 12 and are spaced apart the same distance as strips 20. The front head 40 may be provided with a central opening 56 for the placement of a microphone 58 internally of the drum.

The muffling device 10 is applied to the drum in the manner shown in FIGS. 5 and 6. The muffling device is placed within the drum shell 36, and the bottom strips 20 of pad 12 are applied to the complimentary fastening strips 54 on the drum body. The fastening strips 20 and 54 grip each other in a manner to securely hold the pad 12 in place and yet permit the pad 12 to be detached from the drum body. The tapered shape of the pillow 14 allows its side edges to generally conform to the circular shape of the drumhead The pad 12 is placed a short distance away from the batter head 38 such that the pillow 14 is maintained against the inside surface of the batter head with the pillow flexed about the hinge axis 28 in the position shown in FIG. 5. As previously indicated, the pillow 14 resists flexure about the hinge axis, and the resistance of the pillow to flexure maintains it resiliently against the batter head 38 with the pillow applying a tension force against the batter head due to the flexure.

The microphone 58 may be applied to the top of the pad 12 and maintains securely in place thereon by suitable means such as mating fastening patches 60 which may be hook and loop type fasteners. The cord 58 of the microphone extends through the opening 56.

When the batter head 38 is initially struck by the drumstick 52, the tension force of the pillow 14 against the batter head muffles the initial vibration of the batter head. However, the force of the drumstick striking the batter head displaces the pillow 14 away from the batter head, as shown in FIG. 7. While the pillow is displaced from the batter head, the vibrations of the batter head are not muffled. However, the resistance to flexure exhibited by the pillow causes it to quickly return to a position in which it is maintained against the batter head, and the pillow thereafter muffles the decaying drumhead vibrations In this way, the initial vibration of the drumhead is muffled, while the immediately following vibrations are not muffled. By the time the drumhead vibrations begin to decay significantly and produce undesirable tones, the pillow will have sprung back against the drumhead to muffle the undesirable vibrations and thereby enhance the acoustical properties of the drum.

Figure 8:
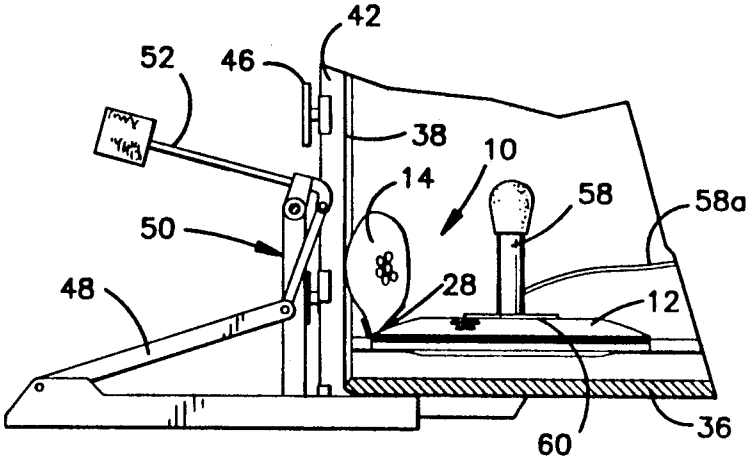
FIG. 8 is a fragmentary sectional view similar to FIG. 7, but showing the muffling device adjusted toward the batter head in order to increase the tension applied to the batter head by the pillow.

The provision of the mating fastening strips permits the device to be adjusted in position in a manner to vary the tension which is applied by the pillow 14 against the drumhead 38. By way of example, FIG. 5 depicts the pad displaced away from the batter head 38 a distance that is greater than its displacement in the position of FIG. 8. Consequently, when the pad is moved to the position of FIG. 8, the flexure of the pillow is increased, and the tension it applies against the drumhead 38 is likewise increased. Additionally, the time the pillow is displaced from the drumhead is decreased in the position of FIG. 8 because of the increased flexure and the increased resistance to the flexure. The position of the pad 12 can be easily adjusted simply by pulling the pad upwardly to detach the strips 20 from the mating strips 54 and then applying strips 20 to strips 54 again when the pad has been adjusted to the desired position.

It is also pointed out that the time the pillow 14 is displaced from the drumhead can be increased by striking the drumhead more forcefully. Consequently, the sound of the drum can be controlled by varying the force with which the drumhead is struck by the drumstick 52

The muffling device 10 applies the same tension force to the drumhead so long as the pad 12 remains in the same place. Therefore, the muffling effect is consistent each time the drumhead is struck with the drumstick At the same time, the "feel" of the drum is enhanced by the presence of the muffling device and the consistency of the tension force it exerts on the drumhead. and the performance of the drummer is enhanced accordingly.

Figure 9:
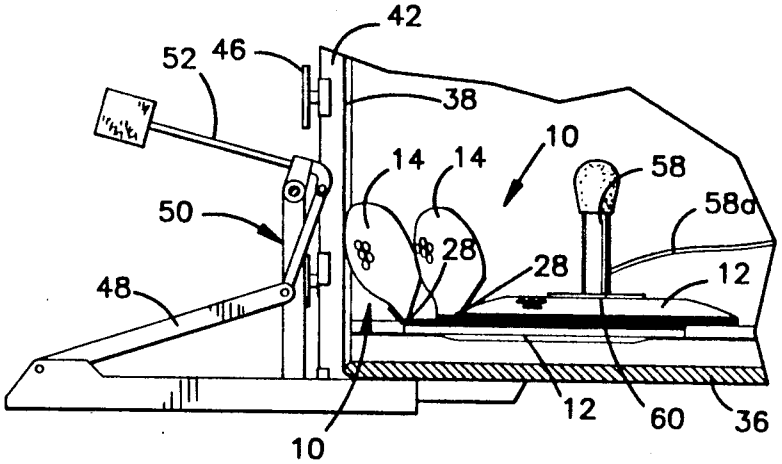
FIG. 9 is a fragmentary sectional view similar to FIG. 7, but showing a second muffling device stacked on top of the first device.

It is another feature of the invention that the construction of the muffling device 10 is such that two or more of the muffling devices can be stacked on one another. For example, FIG. 9 shows two of the devices 10 stacked on top of each other. This is accomplished by applying the first device 10 to the fastening strips 54 in the manner indicated previously and then applying the bottom fastening strips 20 of the second or upper device 10 to the top fastening strips 24 of the first or lower device. The mating connection between the fastening strips 20 and 24 holds the upper device securely in place. As shown in FIG. 9, the pillow 14 of the upper muffling device is in a flexed condition and lies against the pillow 14 of the lower device which in turn directly contacts the batter head 38. The tension forces exerted by the two pillows 14 are applied additively to the drumhead to increase the force of the muffling effect. Additional muffling devices 10 can be stacked on top of one another if more tension is desired. Each device 10 can be adjusted back and forth on the immediately underlying device to vary the tension force applied by its pillow 14.

Figure 10:
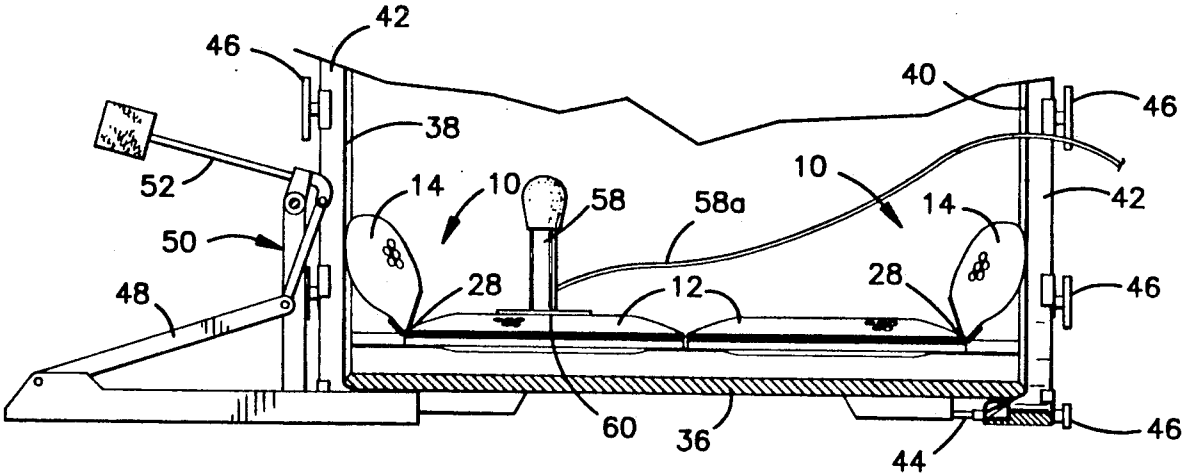
FIG. 10 is a fragmentary sectional view through a bass drum showing a pair of the muffling devices positioned to muffle both the batter head and the front head of a bass drum.

The front head 40 can be muffled at the same time as the batter head 38 by applying a pair of the fastening devices 10 in the arrangement shown in FIG. 10. In this arrangement, one of the devices 10 is applied to the batter head 38 in the manner described previously, and a second device 10 is turned end for end such that it is applied to the fastening strips 54 with its pillow 14 contacting the front head 40 in a flexed condition to provide a muffling effect to the front head in the same manner described previously for the batter head. In the arrangement shown in FIG. 10, the pads 12 are butted together end to end. However, if the pads are longer in comparison to the length of the drum body, the pads will overlap and can be at least partially stacked on one another, with one pillow muffling the batter head 38 and the other pillow muffling the front head 40.

In all arrangements of the muffling device, the microphone 58 can be applied to one of the pads 12 internally of the drum so that internal application of the microphone is always possible It should be noted that the muffling effect provided by the device 10 is useful even if there is no internal microphone used The sound absorbing cores 15 and 30 of the pad 12 and pillow 14, respectively, enhance the muffling effect of the device 10 by absorbing sound waves that reach the cores through the netting which contains them. However, the principal muffling effect is provided by the tension of the flexed pillow 32 against the batter head 38 (or the front head 40 in a situation where the front head is being muffled).

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A muffling device for a bass drum having a drum body and a drumhead on one end of the body, said muffling device comprising:

a pillow comprising sound absorbing material; and means for mounting said pillow in the drum body in a resilient manner urging the pillow about a hinge axis against an inside surface of the drumhead but allowing the pillow to become displaced from the drumhead about said hinge axis temporarily when force is applied to the drumhead, prior to return of the pillow about said hinge axis against the inside surface of the drumhead due to the resilient manner in which the pillow is urged toward said surface about said hinge axis.

2. The muffling device of claim 1, wherein said mounting means comprises means for adjusting the tension of the pillow against the drumhead.

3. The muffling device of claim 1, wherein said pillow comprises a sound attenuating core and netting containing said core therein, said netting presenting mesh openings through which the core is exposed.

4. The muffling device of claim 1, wherein said mounting means comprises:

a pad to which said pillow is connected for flexure about a hinge axis; and means for securing said pad to the drum body at a location to maintain the pillow against the drumhead in a flexed condition wherein the pillow exerts tension against the drumhead.

5. The muffling device of claim 4, wherein said securing means for the pad permits the pad to be adjusted toward and away from the drumhead to vary the tension exerted by the pillow against the drumhead.

6. The muffling device of claim 4, wherein said securing means comprises mating fasteners on the drum body and the pad constructed to accommodate adjustment of the pad toward and away from the drumhead to vary the tension exerted by the pillow against the drumhead.

7. The muffling device of claim 6, wherein said mating fasteners comprise a first pair of strips on the drum body and a second pair of strips on an underside of the pad, said strips in the second pair mating releasably with the strips in the first pair and being applicable thereto at selected locations along the length thereof to permit adjustment of the pad toward and away from the drumhead.

8. The muffling device of claim 1, including:

a second pillow comprising sound absorbing material; and means for mounting said second pillow in the drum body in a flexed condition contacting the first mentioned pillow to combine the tension forces of the two pillows against the drumhead.

9. The muffling device of claim 4, including:

a second pad;

a second pillow connected to said second pad for flexure about a hinge axis; and means for mounting said second pad in a stacked position on the first mentioned pad with said second pillow flexed against the first mentioned pillow and the two pillows exerting tension against the drumhead.

10. The muffling device of claim 9, wherein the drumhead has a second drumhead opposite the first mentioned drumhead and including means for mounting the first mentioned pad and the second pad in the drum body with one of said pillows flexed against the first drumhead and the other of said pillows flexed against the second drumhead.

11. Muffling apparatus for a bass drum having a drum body and a drumhead on the body, said muffling apparatus comprising:

a pad;

a pillow comprising sound absorbing material, said pillow having a hinge connection with said pad and providing spring action resisting flexure of the pillow about said hinge connection; and means for securing said pad to the drum body at a location to maintain said pillow against an inside surface of the drumhead with the pillow flexed about said hinge connection to permit the pillow to move away from the drumhead upon application of force thereto and to return against the drumhead under the influence of said spring action

12. The muffling device of claim 11, wherein said pillow comprises a sound attenuating core and netting containing said core therein, said netting presenting mesh openings through which the core is exposed

13. The muffling device of claim 12, wherein said pad comprises a flat core comprising sound attenuating material and netting containing said flat core and presenting mesh openings through which said flat core is exposed.

14. The muffling device of claim 11, wherein said pad comprises a flat core comprising sound attenuating material and netting containing said flat core and presenting mesh openings through which said flat core is exposed.

15. The muffling device of claim 12, wherein said securing means comprises:

a pair of substantially parallel fastening strips on the drum body extending toward and away from the drumhead; and a pair of substantially parallel fastening strips on said pad applicable to the fastening strips on the drum body and releasably mating therewith to secure the pad to the drum body.

16. In combination with a base drum having a drum body and a drumhead on the body, a muffling device comprising:

a pad comprising sound absorbing material;

a pillow comprising sound absorbing material, said pillow being connected with said pad for flexure about a hinge axis and resisting flexure thereabout by spring action; and means for securing said pad to the drum body at a location inside of the drum body displaced from the drumhead and situated to maintain said pillow against the drumhead in a flexed condition, whereby the pillow is displaced from the drumhead upon application of force thereto and thereafter returns by spring action against the drumhead.

17. The muffling device of claim 16, wherein said securing means comprises means for selectively adjusting the pad toward and away from the drumhead to vary the tension exerted by the pillow against the drumhead.

18. The muffling device of claim 16, wherein said securing means comprises:

a pair of substantially parallel fastening strips on the drum body extending toward and away from the drumhead; and a pair of substantially parallel fastening strips on said pad applicable to the fastening strips on the drum body and releasably mating therewith to secure the pad to the drum body.

19. The muffling device of claim 16, including:

a second pad;

a second pillow connected to said second pad for flexure about a hinge axis; and means for mounting said second pad in a stacked position on the first mentioned pad with said second pillow flexed against the first mentioned pillow and the two pillows exerting tension against the drumhead.

20. A muffling device for a bass drum having a drum body and a drumhead on one end of the body, said muffling device comprising:

first and second pillows each comprising sound absorbing material;

means for mounting said first pillow in the drum body in a resilient manner urging the pillow against an inside surface of the drumhead but allowing the pillow to become displaced from the drumhead temporarily when force is applied to the drumhead, prior to return of the pillow against the inside surface of the drumhead due to the resilient manner in which the pillow is urged toward said surface; and means for mounting said second pillow in the drum body in a flexed condition contacting said first pillow to combine the tension forces of said first and second pillows against the drumhead.

* * * * *